US007049913B2

(12) United States Patent
Wakuda et al.

(10) Patent No.: US 7,049,913 B2
(45) Date of Patent: May 23, 2006

(54) SUPERCONDUCTIVITY MAGNET APPARATUS

(75) Inventors: Tsuyoshi Wakuda, Hitachi (JP); Kohji Maki, Hitachi (JP); Mitsuyoshi Tsuchiya, Hitachi (JP); Michiya Okada, Mito (JP); Hideo Tsukamoto, Hitachi (JP); Souji Kajiura, Hitachi (JP); Shuichi Kido, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/786,012

(22) Filed: Feb. 26, 2004

(65) Prior Publication Data

US 2005/0134414 A1 Jun. 23, 2005

(30) Foreign Application Priority Data

Dec. 18, 2003 (JP) ..... 2003-420794

(51) Int. Cl.
*H01F 7/00* (2006.01)

(52) U.S. Cl. ..... 335/216; 335/296; 324/321

(58) Field of Classification Search ..... 335/216, 335/296–299; 324/318–322, 307, 309, 300, 324/312, 314; 62/47.1
See application file for complete search history.

(56) References Cited

U.S. PATENT DOCUMENTS 6,859,036 B1 * 2/2005 Aihara et al. ..... 324/321
2005/0083059 A1 * 4/2005 Morita et al. ..... 324/318

FOREIGN PATENT DOCUMENTS

JP 7-240310 9/1995

OTHER PUBLICATIONS

"NMR Descriptions", Y. Arata, Published by Maruzen (2000), pp. 326-327.

* cited by examiner

*Primary Examiner*—Lincoln Donovan
(74) *Attorney, Agent, or Firm*—Antonelli, Terry, Stout and Kraus, LLP.

(57) ABSTRACT

The present invention provides a superconductivity magnet apparatus for generating a uniform magnetic field suitable for NMR applications. The superconductivity magnet apparatus has an access port for allowing an access to the center of the magnetic field from an external position separated away from the center in a direction other than the axial direction of a split-type superconductivity electromagnet employed in the magnet apparatus. In the superconductivity magnet apparatus, a gap exists between first and second superconductivity coil blocks facing each other to form the split-type superconductivity electromagnet. To put it in detail, the access port allows an access to a measurement space at the center of the magnet by way of the gap. A configuration element of the magnet such as a coil bobbin is cut out for providing the access port. An area including a deficiency portion caused by the cutout portion or the like is filled up with a material having a relative magnetic permeability in the range 1.000 to 1.002 as an axis-symmetrical area. By using the material with a relative magnetic permeability in the range 1.000 to 1.002, the strength of an erroneously generated magnetic field can be reduced so that a magnet producing a uniform magnetic field can be provided.

19 Claims, 2 Drawing Sheets

SUPERCONDUCTIVITY MAGNET APPARATUS

FIELD OF THE INVENTION

The present invention relates to a superconductivity magnet apparatus having a split-type electromagnet. The superconductivity magnet apparatus is suitable for an application to an NMR (Nuclear Magnetic Resonance) apparatus.

BACKGROUND OF THE INVENTION

In general, the magnet used for the NMR apparatus is constituted by a coaxial nest type multi-layer solenoid. The magnet is placed in such a state that the center axis of the magnet points to the vertical direction. A port for inserting a sample to be measured, which is a through hole in the vertical direction, is provided in the proximity of the center axis of the magnet. The sample is inserted into the port from a position on the upper side, and the probe enclosing an antenna (a detection coil) for detecting a signal is inserted into the port from a position on the lower side.

The sensitivity of detection of an NMR signal varies in dependence on the shapes of the sample and the antenna as well as a positional relation between the sample and the antenna. The sensitivity can be increased by, for example, placing a solenoid-type antenna in a direction perpendicular to a main magnetic field generated by the magnet and placing the sample at a position penetrating the antenna. It's described by pp. 325–326 of "NMR Descriptions" by Youji Arata published by Maruzen in 2,000.

In the conventional NMR, however, the sample cannot be placed perpendicularly to the main magnetic field except for a special application such as a microprobe in which a solenoid-type antenna is wound directly around an extremely small test tube containing the sample. Therefore, placing the sample by such a way is not general.

In order to meet such a problem, a superconductivity magnet apparatus has been proposed configuring the magnet into a split-type, and providing an insertion hole for the sample at a side of the magnet so that the sample can be inserted by utilizing a gap between split magnets. For example it's described in Japanese Patent Laid-open No. H7(1995)-240310.

In general, a strong-magnetic-field superconductivity magnet is made of a compound superconductivity material requiring a high-temperature heat-treatment process, such as $Nb_3Sn$ and $Nb_3Al$ or the like. For this reason, coil bobbins are made of stainless steel, such as SUS316 or SUS316L, having a good heat resistance. However, even the magnetism of SUS316 or SUS316L, which is generally said to be non-magnetic, cannot be ignored in an NMR magnet, and the uniformity of the magnetic field deteriorates due to SUS bobbins.

The coil structure in the conventional NMR magnet is axis-symmetrical. To be more specific, the coil structure is symmetrical on the basis of an axis of the magnetic field or an axis of the coil. Thus, an error magnetic field generated by bobbins is an axis-symmetrical component. With regard to the axis-symmetrical error magnetic field, if a main coil is designed so as to compensate the error magnetic field in advance, no problem will be raised. However, in the case of a split-type magnet allowing the sample to be inserted from the side face of the magnet, due to a cutout of the bobbin for providing bore (through hole), an axis-unsymmetrical error magnetic field, namely an error magnetic field not symmetrical on the basis of an axis, is generated. The NMR magnet cannot compensate the axis-unsymmetrical error magnetic field by merely designing the above main coil.

In order to compensate the error magnetic field caused by a manufacturing error of the magnet, a shim coil group is provided on the NMR magnet. In the NMR magnet, there is also contained a coil for compensating the axis-unsymmetrical error magnetic field. However, the magnitude of the error magnetic field caused by the non-symmetry of the magnet is generally greater than the magnitude of the error magnetic field caused by a manufacturing error of the magnet. In consequence, the size of the coil for compensating the magnetic field considerably increases.

Concerning a superconductivity magnet apparatus, which has a port allowing an access to the center of the magnetic field from the direction other than the axial direction of the magnet, the present invention is intended to generate a uniform magnetic field, without noticeably increasing a magnetic-field compensation power of a magnetic-field compensation means such as a magnetic-field compensation coil.

SUMMARY OF THE INVENTION

The present invention provides a superconductivity magnet apparatus having a split-type electromagnet comprising two blocks each including superconductivity coils. The two blocks are placed facing each other in the axial direction of magnetic fields generated by the superconductivity coils. The superconductivity magnet apparatus also has an access port for allowing an access to a measurement space through a gap between the blocks. In addition, the superconductivity magnet apparatus also includes a support structure body in the gap as a body for supporting an electromagnetic force working between the blocks. The support structure body is made of a material with a relative magnetic permeability in the range 1.000 to 1.002.

In the present invention, an axis-unsymmetrical area caused by a deficiency portion such as a cutout portion for providing the access port is constituted with a material having a relative magnetic permeability close to that of the air. The constitution element of the area preferably may be configured into an axis-symmetrical shape. With such a constitution, the generation of the error magnetic field can be suppressed. If the relative magnetic permeability has a value greater than 1.002, the effect of suppressing the error magnetic field is reduced.

The superconductivity magnet apparatus of the present invention also has a refrigerant container for storing a refrigerant such as helium. The refrigerant is used for keeping the superconductivity coils in a super-conductive state. The split-type electromagnet is contained in the refrigerant container. A measurement space is provided at the center position of the split-type electromagnet or a location in the proximity of the center position. It is desirable to provide an access port in the axial direction of the magnetic field as well as the gap (non-axial direction) of the split-type electromagnet. By providing the two crossing access ports in this way, the sensitivity of detection can be increased. In the present invention, two superconductivity-coil blocks are arranged so that the blocks face each other. Each block can be built as a pair comprising a bobbin and a superconductivity coil wound around the bobbin, and such blocks can be configured by a coaxial multi-layer structure formed by stacking magnetic coils on each other.

In the present invention, it is desirable that the support structure body in the gap between the superconductivity coil blocks is provided so as to have symmetry on the basis of the axis of the magnetic field. The symmetry includes not only structural symmetry, but also electromagnetic symmetry.

In accordance with the present invention, a coil bobbin can be provided as an integration comprising each bobbin of the superconductivity coil blocks and the support structure body.

The present invention provides a superconductivity magnet apparatus in which a constitution element unsymmetrical on the basis of the axis of a magnetic field generated by the superconductivity magnet is made of a material having a relative magnetic permeability in the range 1.000 to 1.002. The unsymmetrical constitution element is included in an area with a radius of 200 mm or, desirably, a radius of 300 mm measured from the center of a split-type electromagnet. This constitution is suitable for magnets with the magnetic-field strength of at least 10 teslas at the center of the magnetic field.

In the present invention, it is desirable that the access port penetrating the gap between the superconductivity coil blocks is also made of a material having a relative magnetic permeability in the range 1.000 to 1.002.

Examples of the material having a relative magnetic permeability in the range 1.000 to 1.002 to be used as a material in the present invention are a copper, an aluminum alloy, an FRP, a titan alloy and a high manganese steel. An example of the aluminum alloy is an alloy of JIS A5056. An example of the titan alloy is an alloy containing Ti, Al with a weight of 6% and V with a weight of 4%. An example of the manganese alloy is an alloy containing Mn with a weight of 32% and Cr with a weight of 7%.

In the superconductivity magnet apparatus comprising a split-type electromagnet, an access port allowing an access to a measurement space by way of a gap between blocks of the split-type electromagnet inevitably causes a deficiency portion such as a cutout portion and an axis-unsymmetrical area. This axis-unsymmetrical area is constituted with a material having a relative magnetic permeability in the range 1.000 to 1.002 extremely close to that of the air. It is desirable to configure the constitution element of the area into an axis-symmetry. According to the present invention, erroneous generation of an axis-unsymmetrical magnetic field can be suppressed, and a uniform magnetic field can thus be generated without noticeably increasing the magnetic-field compensation power of an magnetic-field compensation means such as a magnetic-compensation coil.

PREFERRED EMBODIMENTS OF THE INVENTION

Preferred embodiments of the invention are explained by referring to the diagrams as follows.

First Embodiment

Figure 1:
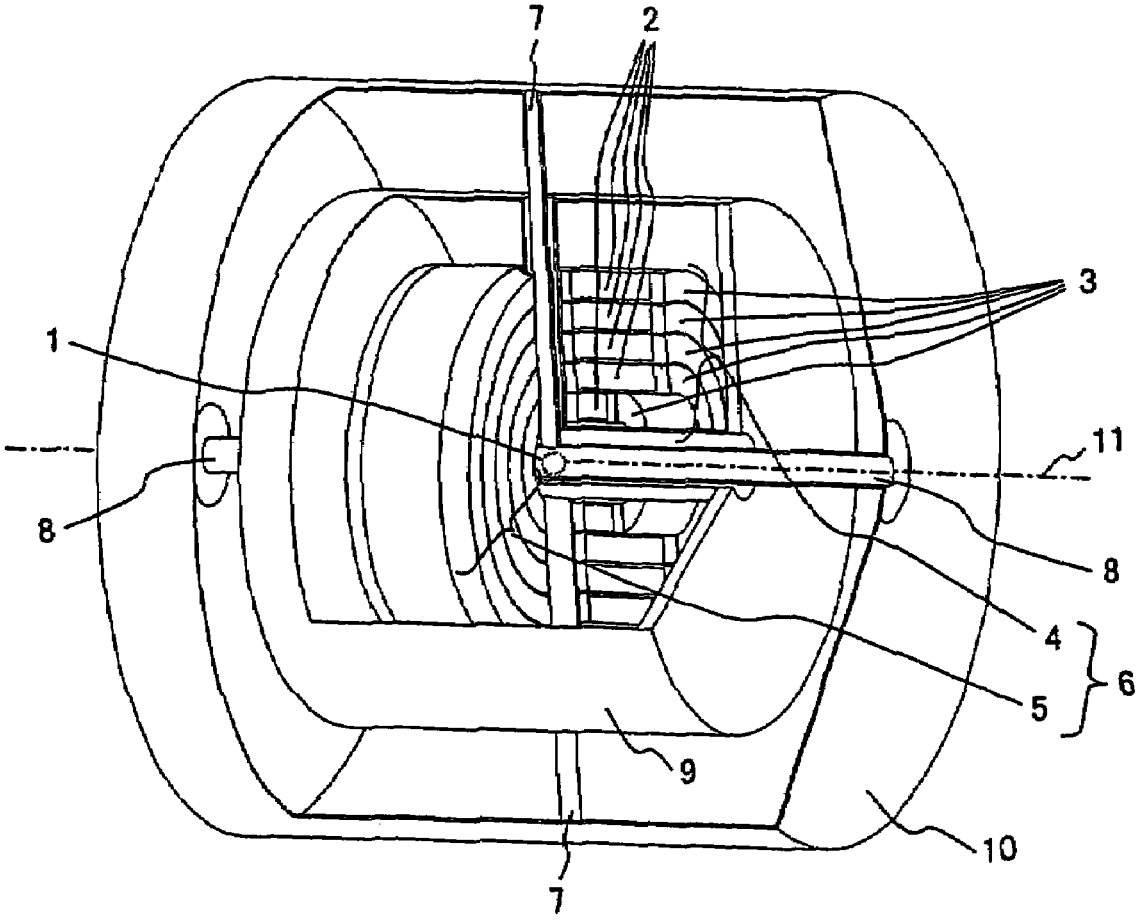
FIG. 1 is a perspective diagram showing a rough perspective view of an embodiment implementing a superconductivity magnet apparatus of the present invention.

A first embodiment of the invention is shown in FIG. 1. A superconductivity wire is wound around coaxial multiple bobbins 3 to form coaxial multiple layer superconductivity coils 2. The first superconductivity-coil block 4 (hereafter it's abbreviated as the first block 4) is configured by forming the superconductivity coils 2 into such a coaxial multi-layer structure. The second superconductivity-coil block 5 (hereafter it's abbreviated as the second block 5) is placed so as to face the first block 4. The configuration of the second block 5 is the same as that of the first block 4. The first block 4 and the second block 5 are arranged in the state of facing mutually so that the axes of magnetic fields generated by their respective coils coincide on the direction, and there is a gap between the blocks 4 and 5. The direction of the axis 11 of the magnetic field is also the direction of the axis of each coil. A split-type electromagnet 6 is configured by joining the first block 4 and the second block 5 in the direction of their axes. Although the first block 4 having five layer superconductivity coils is drawn on FIG. 1, it is by reason of the convenience for drawing the figure, in actuality, the first block 4 comprises ten layer superconductivity coils 2. The configuration of the second block 5 is also the same as that of the first block 4. In both blocks 4 and 5, seven inside layers of ten layer superconductivity coils are composed of a compound superconductivity wire each made of $Nb_3Sn$, and the remaining three outside layers are composed of a compound superconductivity wire each made of an NbTi alloy. The reason the coils are deliberately made of two different kinds of superconductivity wire material as described above, is that the inside coils close to the center of the magnet consist of a material generating a large critical magnetic field, and that the outside coils consist of a material having a large mechanical strength. On the outer side of the ten layer coils, a shim coil not shown in the figure is further provided for compensating an error magnetic field caused by manufacturing errors of the coils. For example the split-type electromagnet 6 has an external diameter of 1,200 mm.

The split-type electromagnet 6 is contained in a liquid-helium container 9 holding a helium liquid as a refrigerant so that the superconductivity coils can be kept in a superconductive state. A radiation shield is provided on the outside of the liquid-helium container 9 for reducing the amount of heat introduced into the container 9 from external sources. The liquid-helium container 9 further has a liquid-nitrogen tank. The radiation shield and the liquid-nitrogen tank are not shown in FIG. 1 to make the drawing simple. The split-type electromagnet 6, the liquid-helium container 9, the radiation shield and the liquid-nitrogen tank are contained in a vacuum container 10. At the center of the split-type electromagnet 6, a measurement space 1 in which the strength of the magnetic field is controlled, is provided for measuring an NMR signal. The first access port 7 and the second access port 8 are each provided for making an access to the measurement space 1 from an external location. The first access port 7 is provided so as to allow to access to the measurement space 1 from a external position in the direction perpendicular to the axis 11 of magnetic fields generated by the coils through the gap in the split-type electromagnet 6. On the other hand, the second access port 8 is provided so as to allow to access to the measurement space 1 from an external position in the direction of the axis 11. In the magnet of the embodiment, the strength of the magnetic field in the measurement space 1 is 14.1 teslas. The strength of this magnetic field is equivalent to the strength of a magnetic field for resonance frequency of 600 MHz of a proton NMR As described above, the access ports 7 and 8 are formed to allow accesses to the measurement space 1 through the gap (sprit gap) of the split-type magnet 6 provided by the present invention. In addition, a strong electromagnetic force works between the first block 4 and the second block 5 toward shrinking the gap between them. Thus, a support structure body for supporting the electromagnetic force is required between the coils of both the blocks.

In order to prevent the coil winding portions of the bobbins from deforming due to the electromagnetic force, increasing the thickness of a flange of the coil bobbin facing the sprit gap in the split-type electromagnet is effective. In addition, it is desirable to provide the support structure body with symmetry on the basis of the magnet axis, that is, the axis 11 of the magnetic fields generated by the coils, and to provide a support structure body having a sufficiently large capacity.

Figure 2:
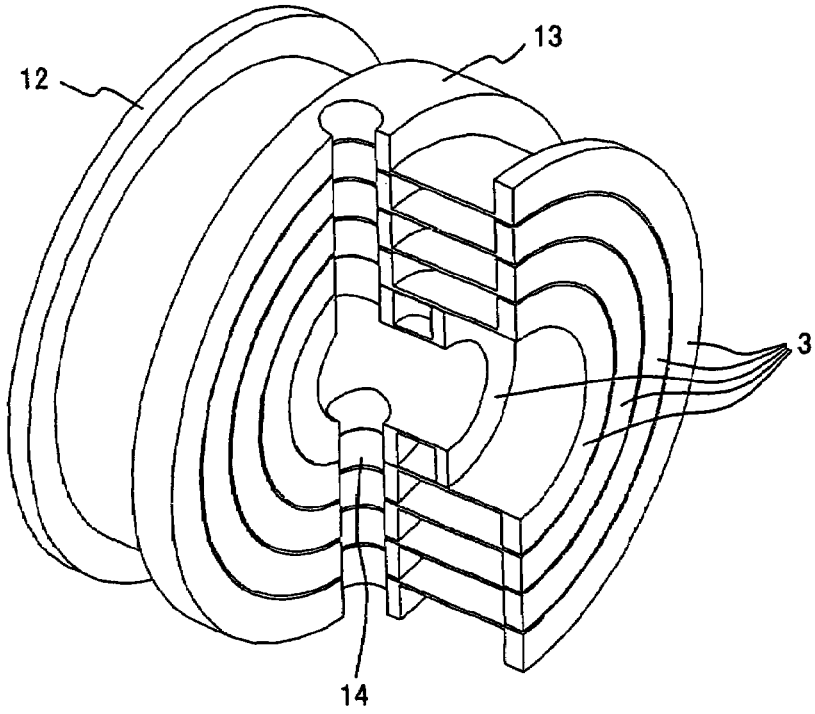
FIG. 2 is a perspective diagram roughly showing components in close proximity to bobbins used in an example of the superconductivity magnet apparatus of the present invention.

In order to satisfy such conditions, it is desirable to fill up a gap between each bobbin 3 of the first block 4 and each bobbin 12 of the second block 5 with an in-gap support structure body 13 so as to integrate the bobbin 3 and the bobbin 12 into a single assembly as shown in FIG. 2. The support structure body 13 in the gap is made of a material having a relative magnetic permeability equal or approximately equal to that of the air. The support structure body 13 is bored to form a through hole 14 at an area in which the first access port 7 is located.

In this embodiment, $Nb_3Sn$ is used as a material of which coils are made for generating a magnetic field with the strength of 14.1 teslas. $Nb_3Sn$ used as a material for making $Nb_3Sn$ wires is produced in a heat-treatment process for 100 hours at a temperature of about 960 degrees Celsius, and thereby can be used as a superconductivity wire material. Since $Nb_3Sn$ is very fragile, even a bending distortion of about 0.2% occurring in the material inevitably deteriorates the superconductivity current transportation characteristic thereof. For this reason, a wind & react method is generally adopted as a method for making a superconductivity coil of a magnet designed with a small bending diameter as a magnet for an NMR application. In accordance with this method, a wire material is wound around the bobbin before a heat-treatment process and, later on, the heat-treatment process is carried out. Since a heat-treatment process carried out at a high temperature is required for making an $Nb_3Sn$ coil, austenite stainless steel such as SUS316 having a good heat resistance and an excellent mechanical strength is normally used as a material of the coil bobbin. In general, SUS316 is treated like a non-magnetic material. However, in a magnetic field of 14 teslas and in a low-temperature range of 4.2 K, SUS316 exhibits a magnetization of about 0.13 teslas.

If the shape of each bobbin has an axis symmetry, such as conventional NMR magnet, and a error magnetic field generated by the bobbin portion also has an axis symmetry, the coil can just be designed by considering such an error magnetic field symmetry. In this case, no problem is caused even if the bobbin material has a magnetization of 0.13 teslas.

However, in the case of the magnet provided by the present invention, since the magnet has the access ports allowing an access to a measurement space by through the split gap, the bobbin portion including the support structure body 13 is cut-out unsymmetrically on the basis of the axis. In consequence, an error magnetic field unsymmetrically generates. In addition, the error magnetic field generates mainly in the proximity of the center of the magnet. It is thus extremely difficult to install a compensation coil for compensating the error magnetic field. As a result, using the bobbin material having a magnetization of 0.13 teslas will cause a problem.

In order to solve the problem described above, in this embodiment, the whole of the bobbin including the support structure body 13 is made of a material having a relative magnetic permeability very close to that of the air. Thereby, the error magnetic field caused due to a cutout provided for an access port is suppressed effectively. A standard for selecting materials of the bobbin and the support structure body is that a relative magnetic permeability does not exceed 1.002. For example, for satisfying above standard, a titan alloy containing Ti, Al with a weight of 6% and V with a weight of 4% is used for the material of bobbins close to the center of the magnet. On the other hand, a manganese alloy containing Mn with a weight of 32% and Cr with a weight of 7% is used for the material of bobbins located in areas separated away from the center. While the materials described above are used in this embodiment, materials for the present invention are not limited to these materials. That is, other materials can also be used as long as the other materials have an excellent resistance against the high temperature of the heat-treatment process of $Nb_3Sn$ and have a relative magnetic permeability in the range 1.000 to 1.002.

The magnet of the embodiment has two access ports crossing each other at the center of the magnet. The access ports penetrating the gap in the split-type electromagnet have a structure unsymmetrical on basis of the axis, so this portion also erroneously generates a magnetic field unsymmetrical on basis the axis. Since this portion is located in proximity of the measurement space, its unsymmetrical magnetic field affects the uniformity of the magnetic field greatly. In order to solve this problem, in the case of this embodiment, an aluminum alloy of JIS A5056 is applied to the access ports. This aluminum alloy has a relative magnetic permeability in the range 1.000 to 1.002. The access ports are not limited the material to the aluminum alloy. For example, a copper can also be used as a substitute for the aluminum if this copper material has a relative magnetic permeability in the range 1.000 to 1.002.

The magnet in this embodiment is capable of generating a magnetic field having a magnetic-field strength of 14.1 teslas while suppressing the strength of the error magnetic field into a value not greater than 1 ppb inside a 20-mm spherical surface. And the effect can be achieved without noticeably increasing the magnetic-field compensation power of a shim coil for compensating error magnetic field caused by manufacturing errors and the magnetic-field compensation power of a current shim placed inside a bore at a normal temperature.

Second Embodiment

In the case of the first embodiment, the entire bobbin including the support structure body 13 is made of a material having a relative magnetic permeability in the range 1.000 to 1.002. However young's modulus of the titan alloy used in the first embodiment is smaller than that of stainless steel. And fabrication and welding processes to titan are not easy. The high manganese steel used the first embodiment is difficult to obtain and to fabricate easily.

Figure 3:
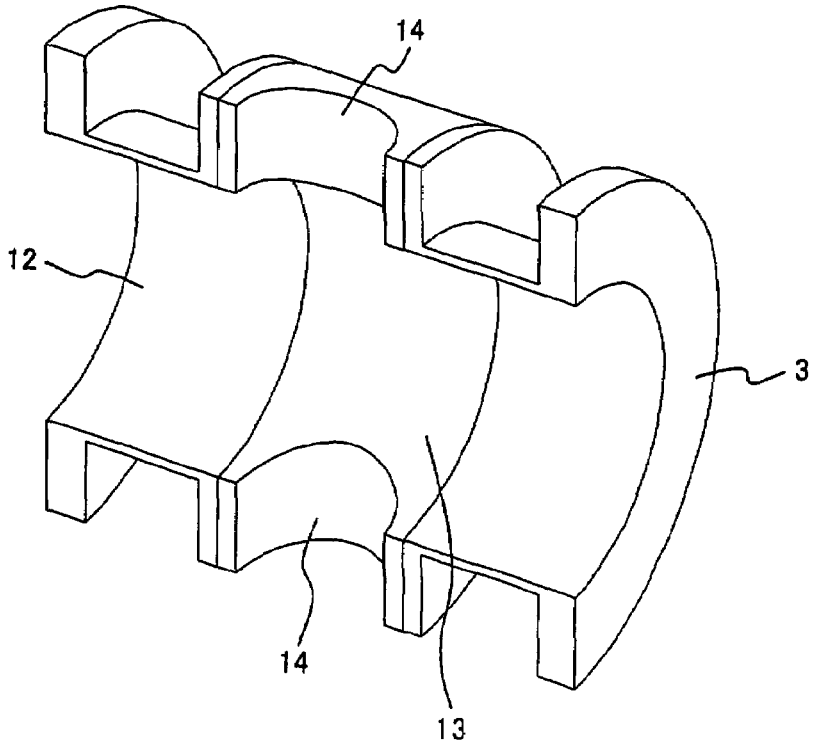
FIG. 3 is a perspective diagram showing a perspective view of an embodiment implementing the bobbins used in the superconductivity magnet apparatus of the present invention.

Considering above-mentioned matter, in the case of the second embodiment, the bobbins 3 and 12 and the support structure body 13 are made of different materials, and they are formed into a single assembly as shown in FIG. 3. To put it concretely, a stainless steel, i. e., SUS316 or SUS316L is used as material for the bobbins 3 and 12 requiring high durability and large Young's modulus. On the other hand, as material for the support structure body 13 including a cutout such as the through (penetrating) hole 14 of the first access port 7, a copper having a relative magnetic permeability in the range 1.000 to 1.002 is used. In this way, split coils are made so as to include an axis-symmetrical area filled up with a material having a relative magnetic permeability in the range 1.000 to 1.002. The bobbins 3 and 12 and the support structure body 13 are made into a single assembly by HIP process.

In this embodiment, an axis-unsymmetrical area, caused by a deficiency portion such as a cutout portion for providing the access port, is constituted with a material having a relative magnetic permeability close to that of the air. The constitution element of the area is configured into an axis-symmetrical shape. With such a constitution, the generation of the error magnetic field can be suppressed.

This embodiment can provide coil bobbins capable of suppressing the error magnetic field unsymmetrical while having a mechanical strength against hoop forces of the coils. As a result, the magnet implemented by this embodiment is capable of generating a magnetic field having a magnetic-field strength of 14.1 teslas while suppressing the strength of the error field to a value not greater than 1 ppb inside a 20-mm spherical surface. The effects are achieved without noticeably increasing the magnetic-field compensation power of a shim system for compensating the error magnetic field caused by manufacturing errors, and without increasing the magnetic-field compensation power of a current shim placed inside a bore at a normal temperature.

In the split-type electromagnet provided by the present invention, which allows an access to the center of the magnetic field generated by the magnet from an external position in a direction other than the axial direction of the magnet, can suppress the error magnetic field caused the unsymmetrical structure. Thereby, NMR measurements can be carried out at a high speed. As a result, the efficiency of production to make medicines and the efficiency of a protein analysis can be improved considerably so that the split-type electromagnet of the present invention much contributes to the development of the industry.

What is claimed is:

1. A superconductivity magnet apparatus comprising:

a split-type electromagnet including two superconductivity coil blocks having respective coils made by winding a superconductivity wire around each bobbin, wherein said superconductivity coil blocks are placed so as to face each other having the gap between said superconductivity coil blocks in the axial direction of a magnetic field generated by said coils;

a support structure body provided at said gap to support an electromagnetic force working between said superconductivity coil blocks, and made of a material having a relative magnetic permeability in the range 1.000 to 1.002;

a refrigerant container for cooling said split-type electromagnet to keep said coils in a super-conductive state; and an access port for accessing to a measurement space provided at the center of said split-type electromagnet or in the proximity of there through said gap.

2. A superconductivity magnet apparatus according to claim 1, wherein said each superconductivity coil block is configured by winding a superconductivity wire around each bobbin to make each coil, and stacking the coils each other to form a coaxial multi-layer coil structure.

3. A superconductivity magnet apparatus according to claim 1, wherein said material having a relative magnetic permeability in the range 1.000 to 1.002 is a copper, an aluminum alloy, an titan alloy, an FRP or a high manganese steel.

4. A superconductivity magnet apparatus according to claim 1, wherein said support structure body has an axis symmetry on the basis of the axis of said magnetic field.

5. A superconductivity magnet apparatus according to claim 1, wherein an area constituted by said material having a relative magnetic permeability in the range 1.000 to 1.002 is configured so as to have magnetically an axis symmetry on the basis of the axis of said magnetic field.

6. A superconductivity magnet apparatus according to claim 1, further having another access port for allowing an access to said measurement space from a external position of said superconductivity coil blocks in the axial direction of said magnetic field.

7. A superconductivity magnet apparatus comprising:

a split-type electromagnet including the first superconductivity coil block having coils made by winding a superconductivity wire around coaxial multiple bobbins and a second superconductivity coil block configured like said first superconductivity coil block, further placing said first and second superconductivity coil blocks having the gap in the state of facing mutually so that the axes of magnetic fields generated by their respective coils coincide on the direction;

a refrigerant container containing said split-type electromagnet and a refrigerant for cooling said split-type electromagnet so as to keep the coils in a superconductive state;

a measurement space provided at the center of said split-type electromagnet or in the proximity of there; and an access port for allowing an access to said measurement space through said gap between said first and second superconductivity coil blocks, wherein said bobbins of said first superconductivity coil block and said bobbins of said second superconductivity coil block are integrated with each other to form a single assembly, sandwiching a support structure body made of a material having a relative magnetic permeability in the range 1.000 to 1.002.

8. A superconductivity magnet apparatus according to claim 7, wherein said first and second superconductivity coil blocks comprises the coils made by winding a superconductivity wire around respective bobbins, and by stacking the coils each other to form a coaxial multi-layer coil structure.

9. A superconductivity magnet apparatus according to claim 7, wherein said material having a relative magnetic permeability in the range 1.000 to 1.002 is a copper, an aluminum alloy, a titan alloy, an FRP or a high manganese steel.

10. A superconductivity magnet apparatus according to claim 7, wherein said bobbins of said first superconductivity coil block and said bobbins of said second superconductivity coil block are each made of a material having a relative magnetic permeability in the range 1.000 to 1.002.

11. A superconductivity magnet apparatus according to claim 8, wherein said first and second superconductivity coil blocks having said coaxial multi-layer structure comprising:

inside coils made of Nb3Sn and placed at locations in the proximity of said center of said split-type electromagnet;

outside coils made of a NbTi alloy and placed at locations far away from said center of said split-type electromagnet;

inside bobbins for winding said inside coils and made of a titan alloy having a relative magnetic permeability in the range 1.000 to 1.002; and outside bobbins for winding said outside coils and made of a high manganese steel having a relative magnetic permeability in the range 1.000 to 1.002.

12. A superconductivity magnet apparatus according to claim 7, wherein said bobbins are each made of stainless steel and said support structure body is made of copper.

13. A superconductivity magnet apparatus according to claim 12, wherein said stainless steel and said copper are integrated to form a single body in an HIP process.

14. A superconductivity magnet apparatus according to claim 7, wherein said access port is made of a material having a relative magnetic permeability in the range 1.000 to 1.002.

15. A superconductivity magnet apparatus according to claim 7, further having another access port for allowing an access to said measurement space from an external position of said split-type electromagnet to said measurement space in the axial direction of said magnetic field.

16. A superconductivity magnet apparatus having a configuration according to claim 1, wherein said superconductivity magnet apparatus is used in nuclear magnetic resonance apparatus.

17. A superconductivity magnet apparatus having a configuration according to claim 7, wherein said superconductivity magnet apparatus is used in nuclear magnetic resonance apparatus.

18. A superconductivity magnet apparatus, wherein a split-type electromagnet is configured by joining two superconductivity coil blocks which have coils made by winding a superconductivity wire around each bobbin, and said superconductivity coil blocks are placed so as to face each other having the gap between said superconductivity coil blocks in the axial direction of a magnetic field generated by said coils;

said split-type electromagnet is contained in a refrigerant container so as to keep said coils in a super-conductive state;

an access port is provided in said gap so as to can insert a sample to a measurement space located at the center of said split-type electromagnet or in the proximity of there the gap, and a configuration element included in an area within a radius of 200 mm from said center of said split-type electromagnet and having an axis-unsymmetrical structure on basis of axis of said magnetic field, is made of a material having a relative magnetic permeability in the range 1.000 to 1.002.

19. A superconductivity magnet apparatus according to claim 18, wherein the strength of said magnetic field at said center of said split-type electromagnet is at least 10 teslas.

* * * * *